US007857580B1

(12) United States Patent
Liang

(10) Patent No.: US 7,857,580 B1
(45) Date of Patent: Dec. 28, 2010

(54) TURBINE VANE WITH END-WALL LEADING EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 801 days.

(21) Appl. No.: 11/521,745

(22) Filed: Sep. 15, 2006

(51) Int. Cl.
*F01D 9/06* (2006.01)

(52) U.S. Cl. ..... 415/115

(58) Field of Classification Search ..... 415/115, 415/116; 416/95, 96 R, 96 A, 97 R, 97 A; 60/752, 806
See application file for complete search history.

(56) References Cited

U.S. PATENT DOCUMENTS 4,187,054 A * 2/1980 Landis et al. ..... 415/115
5,417,545 A 5/1995 Harrogate
5,470,198 A 11/1995 Harrogate et al.
6,082,961 A 7/2000 Anderson et al.
6,402,463 B2 * 6/2002 Jang et al. ..... 415/115
7,004,720 B2 2/2006 Synnott et al.
2004/0161336 A1 * 8/2004 Imbourg et al. ..... 415/211.2

* cited by examiner

*Primary Examiner*—Christopher Verdier
(74) *Attorney, Agent, or Firm*—John Ryznic

(57) ABSTRACT

A first stage guide vane used in a gas turbine engine, the guide vane including an airfoil portion extending between an inner shroud and an outer shroud, each shroud having an extension to form a flow transition for the hot gas flow from the combustor to the guide vane, and where the leading edge of the shroud extensions include a plurality of diffusion cooling holes opening onto the surface of the shroud extension to provide film cooling. Each diffusion cooling hole is in fluid communication with a cooling supply channel that runs along the shroud extension to provide convective cooling of the shroud extension; the cooling supply channel includes a metering hole to regulate the flow of cooling air into the channel. In the preferred embodiment, each diffusion cooling hole includes a separate cooling supply channel and a metering hole in order to regulate the individual cooling diffusion hole cooling air flow to provide specific cooling requirements for the specific location of the diffusion hole.

10 Claims, 4 Drawing Sheets

TURBINE VANE WITH END-WALL LEADING EDGE COOLING

BACKGROUND OF THE INVENTION

1. Field of the Invention

The present invention relates generally to rotary kinetic fluid motors or pumps, and more specifically to a turbine airfoil with end-wall cooling.

2. Description of the Related Art Including Information Disclosed Under 37 CFR 1.97 and 1.98

In a gas turbine engine, a hot gas flow is passed through a turbine to produce mechanical power. One method of increasing the efficiency of the gas turbine engine is to increase the temperature of the flow through the turbine. A typically turbine includes four stages of stationary vanes (also referred to as a nozzle) and rotor blades (also referred to as buckets) arranged in an alternating manner such that the vanes guide the flow into the blades. The first stage vane is exposed to the hottest temperature flow since the vane is located directly downstream from the combustor.

In order to allow for temperature higher than the melting temperature of the material used in the vane, designers have used complex cooling passages through the airfoils to provide cooling and therefore allow for higher flow temperatures to increase efficiency. Also, since the cooling air supplied to the airfoils for cooling must be under high pressures to prevent backflow from the hot gas into the airfoils, the cooling air is generally supplied from a middle stage of the compressor. Diverting compressed air from the compressor instead of using it with a fuel in the combustor also reduces the efficiency because the work used for compressing the cooling air is generally lost. Thus, providing an improvement in the cooling of the airfoil and reducing the amount of cooling air used for the same amount of cooling effectiveness would improve the efficiency of the engine. Higher efficiency means more power for the same amount of fuel.

U.S. Pat. No. 5,417,545 issued to Harrogate on May 23, 1995 entitled COOLED TURBINE NOZZLE ASSEMBLY AND METHOD OF CALCULATING THE DIAMETERS OF COOLING HOLES FOR USE IN SUCH AN ASSEMBLY discloses a turbine nozzle (vane) with an outer platform having an airfoil extending therefrom, and 2 rows of angled cooling holes located on the upstream end of the upper platform to supply cooling air to the platform and cooling the vane (see FIG. 1). The platform forms a smooth transition of the hot gas flow from the combustor to the guide vanes and is therefore exposed to the hot gas flow temperature. The cooling holes deliver necessary cooling to the transition platform.

As a result of the Harrogate cooling construction, streamwise and circumferential cooling flow control due to airfoil external hot gas temperature and pressure variation is difficult to achieve. Film cooling air discharged from the double film rows has a tendency to migrate from the pressure side toward the vane suction surface which induce an uneven distribution of film cooling flow and end-wall metal temperature.

It is therefore an object of the present invention to provide for an improvement in the cooling of a leading edge end-wall (platform) of a turbine vane from that of the Harrogate patent.

BRIEF SUMMARY OF THE INVENTION

A turbine nozzle or guide vane for a first stage of a turbine with an end-wall or platform forming a transition for the hot gas flow from the combustor to the guide vane, the leading edge of the platform includes multiple metering diffusion submerged cooling channels arranged along the leading edge.

The submerged cooling channels include a metering cooling flow entrance section in conjunction with submerged diffusion exit channels. The multiple metering diffusion submerged cooling slot is constructed in small module formation. Individual modules are designed based on airfoil gas side pressure distribution in both stream-wise and circumferential directions. In addition, each individual module can be designed based on the airfoil local external heat load to achieve a desired local metal temperature. These individual small modules are constructed in an inline or staggered array along the end-wall leading edge section. With the cooling construction design of the present invention, the usage of film cooling air for a given air inlet gas temperature and pressure profile is improved over the cited prior art.

DETAILED DESCRIPTION OF THE INVENTION

Figure 1:
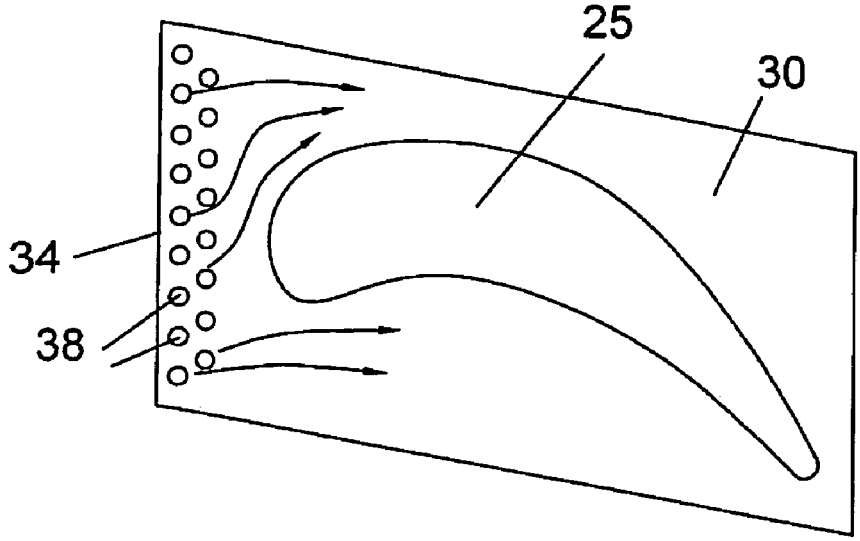
Fig 1 Prior Art
FIG. 1 shows a bottom view of a guide vane with the prior art 2 rows of cooling holes on the leading edge.
Figure 2:
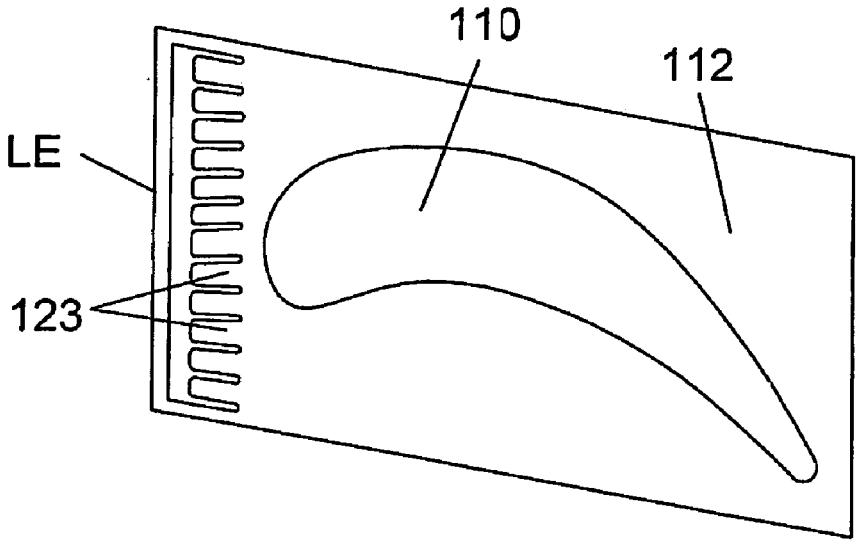
FIG. 2 shows a bottom view of the present invention multi-metering diffusion cooling hole design.
Figure 3:
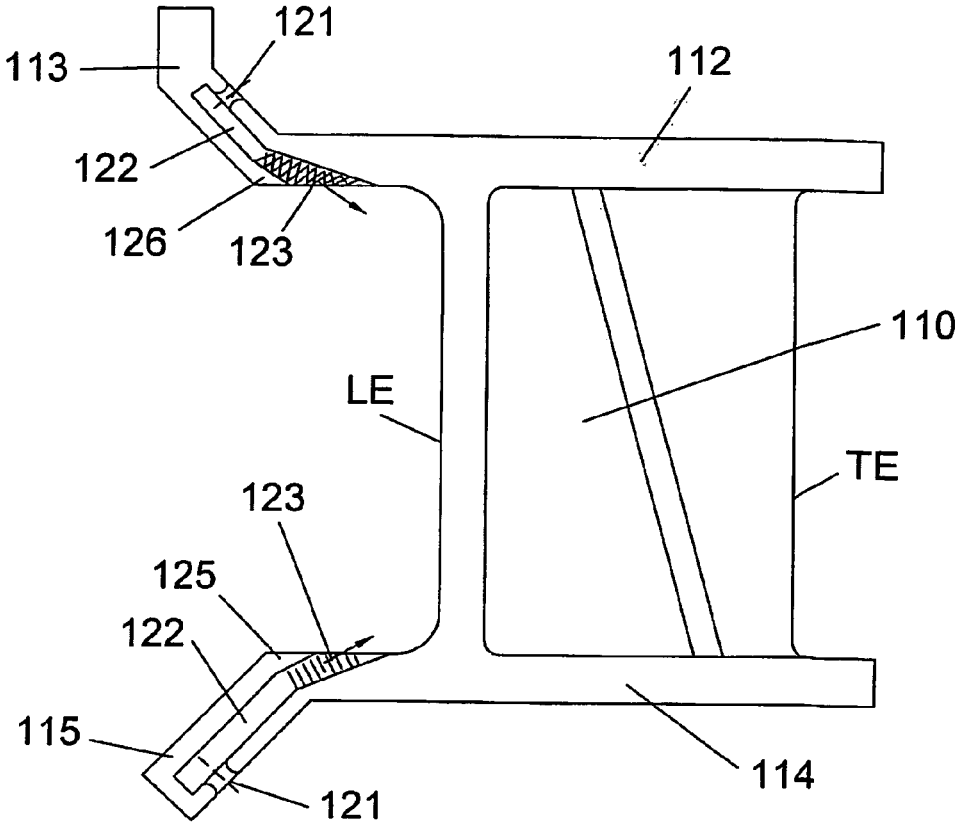
FIG. 3 shows a cross section view of the guide vane of the present invention from FIG. 2.

A gas turbine engine includes a plurality of first stage vanes or nozzles located between the combustor outlet and the first stage rotor blades. FIGS. 2 and 3 show the first stage stationary vane or guide nozzle having an airfoil 110 extending between an outer shroud or end-wall 112 and an inner shroud or end-wall 114. An outer shroud extension 113 extends from the outer shroud toward an upstream direction to form a smooth transition of the flow from the combustor into the first stage vanes. An inner shroud extension 115 extends from the inner shroud 114 to form a transition as well. The shroud extension is considered to end just before the vane leading edge of the airfoil. The shroud extensions are shown to be flat and angled. However, the shroud extensions can be of any shape used in vanes of the prior art.

Located within the two shroud extensions are the cooling channels and diffusion holes of the present invention. A metering hole 121 is located in the inner shroud extension 115 and provides cooling air from the source below the shroud 114. A cooling channel 122 located within and passing substantially along the shroud extension 115 is connected with the metering bole 121 and opens into a submerged diffusion exit slot 123. The outer shroud extension 113 includes a metering hole 121 opening into a submerged diffusion exit slot 123, which opens into a submerged exit channel as in the inner shroud extension 115. Cooling air is supplied to the metering hole in the outer shroud extension 113 from a source above the outer shroud 112. A lip 125 is formed on the inner shroud extension and a lip 126 is formed on the outer shroud extension and acts to direct the cooling air discharging onto the end-wall surface to form film cooling flow. FIG. 2 shows a plurality of the submerged cooling slots 123 opening onto the surface of the outer shroud extension 113 and extending substantially along the shroud leading edge. The multi-metering diffusion submerged cooling slot 123 shown in the outer shroud extension 113 is the same construction to that shown on the inner shroud extension 115. Each diffusion slot 123 is in fluid communication with a separate channel 122 and metering hole 121. However, two or more diffusion slots 123 could be supplied by a common channel and metering hole, or all of the diffusion slots 123 could be supplied by a single channel and metering hole. Using separate channels and metering holes for each diffusion slots 123 will allow for the cooling flow to be regulated individually based upon the cooling requirements for the specific diffusion slot. The size of the metering hole 121 can be varied to regulate the amount of cooling air flowing into the respective channel 122. The diffusion slots 123 for this invention is considered to be a diffuser opening onto the surface of the shroud extension that will produce diffusion in the cooling air flow. The cooling holes of the Harrogate patent referred to above are not diffusion holes since the holes open onto the platform surface without expanding in cross sectional area as would a diffuser.

Figure 4:
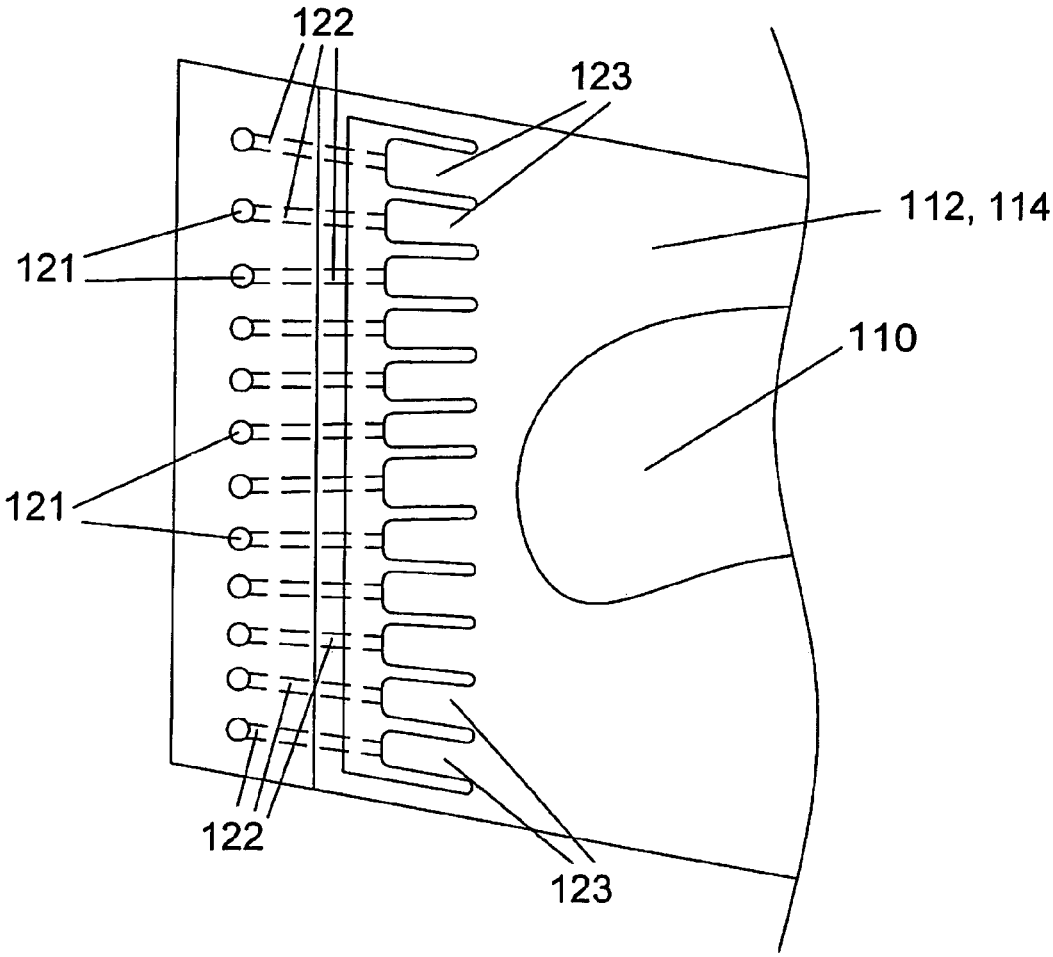
FIG. 4 shows a cross section view of the platform leading edge with separate cooling holes and channels for each diffusion slot.
Figure 5:
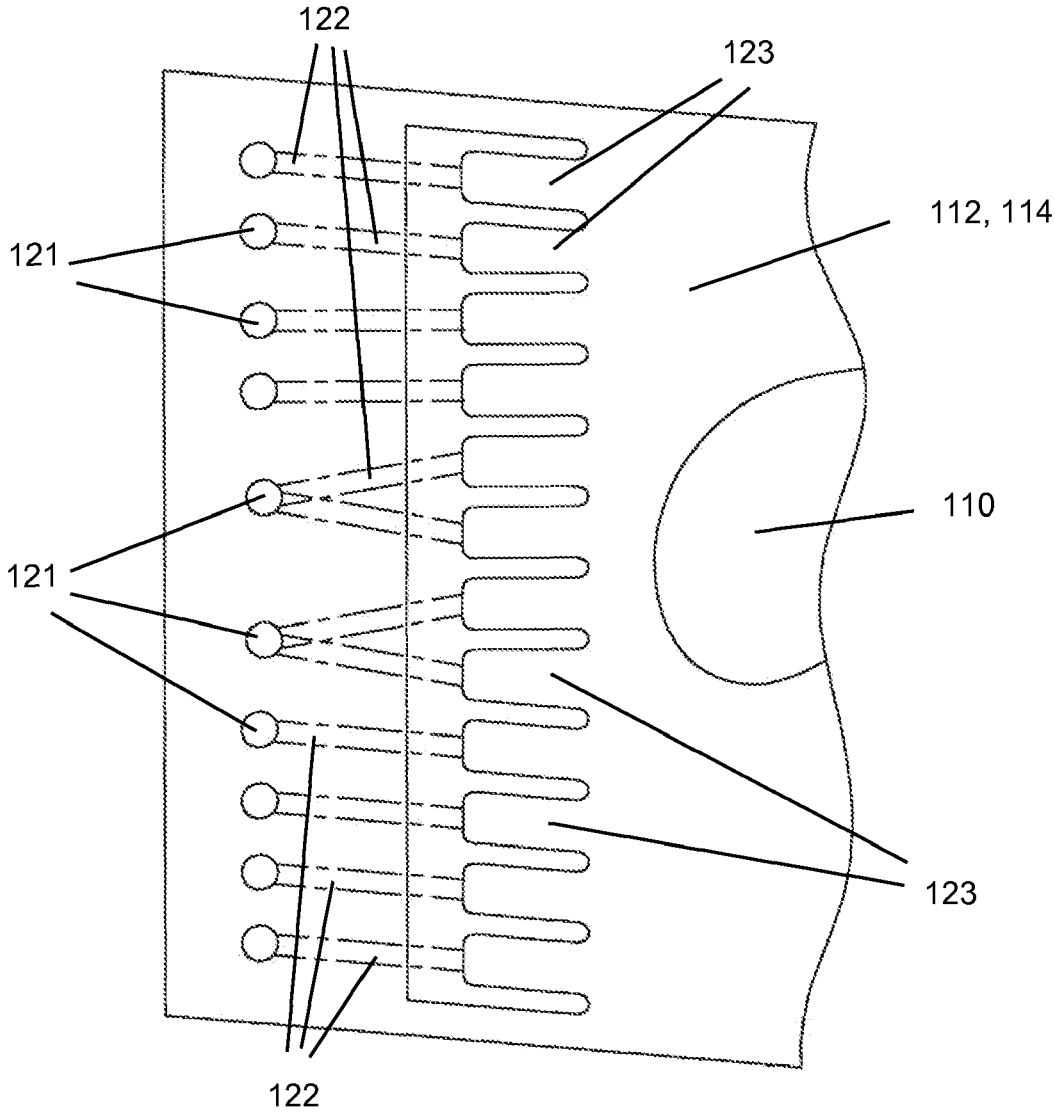
FIG. 5 shows a cross section view of the platform leading edge with some of the diffusion slots connected to separate cooling supply channels with a separate metering hole.

FIG. 4 shows a cross section view of the platform leading edge section for both the inner shroud 112 and the outer shroud 114 in which the diffusion slots 123 are each supplied with cooling air by a separate metering hole 121 and cooling channel 122. As in previous embodiments, each metering hole 121 can be sized to deliver a certain amount of cooling air to the cooling channel 122 and thus the diffusion slot 123 in order to tailor the platform cooling based upon a number of design factors.

The multiple metering diffusion submerged cooling slot is constructed in small module formation. The individual module is designed according to the cooling requirements as based on airfoil gas side pressure distribution in both stream-wise and circumferential directions. Each individual module can be designed based on the airfoil local external heat load to achieve a desired local metal temperature. The individual small module is constructed in an inline or staggered array along the end-wall leading edge section. With the cooling passage design of the present invention, the use of film cooling air is maximized for a given airfoil inlet temperature and pressure profile.

In operation, cooling air is provided by the vane cooling supply manifold. Cooling air is metered at the entrance section of the multiple metering diffusion submerged film cooling slot through the metering holes 121 to closely match the hot gas flow conditions prior to being discharged from the submerged slots. The film cooling exit slot 123 is submerged below the airfoil surface to provide for proper cooling flow spacing for the discharged cooling air and, therefore minimizing the shear mixing between the discharged film cooling air and hot flow gas. This result enhances the cooling effectiveness for end-wall or shroud leading edge. Since the cooling air is metered and diffused in the long submerged cooling channel 122, this allows the cooling air to be distributed uniformly within the film cooling channel 122 and reduces the film cooling air exit momentum. Coolant penetration into the gas path is thus minimized, yielding good build-up of the coolant sub-boundary layer next to the end-wall leading edge surface, providing for a better film coverage in stream-wise and circumferential directions for the end-wall leading edge region.

In addition, the exit portion of the multiple metering diffusion submerged cooling slot is constructed with multiple flow surfaces which generates additional convection area for the end-wall leading edge region. This combination of additional convection cooling and multi-diffusion film cooling at very high film coverage yields a very high cooling effectiveness and uniform wall temperature for the vane end-wall leading edge region.

I claim the following:

1. A guide vane for use in a gas turbine engine, the guide vane comprising:

a airfoil extending from an inner shroud to an outer shroud;

an shroud extension extending from one of the inner shroud and the outer shroud and forming a flow transition from a location upstream from the vane;

a diffusion slot opening onto the surface of the shroud extension;

a cooling supply channel located within the shroud extension; and, a metering hole providing a fluid communication from a cooling air source to the cooling supply channel such that cooling air flows from the source through the diffusion slot and onto the shroud extension to cool the vane.

2. The guide vane of claim 1, and further comprising:

a plurality of diffusion slots opening onto the shroud extension surface and extending substantially along the shroud leading edge.

3. The guide vane of claim 2, and further comprising:

each diffusion slot is in fluid communication with a separate cooling supply channel and a separate metering hole.

4. The guide vane of claim 3, and further comprising:

the metering holes are individually sized to provide a specific cooling air flow into the respective diffusion slot.

5. The guide vane of claim 1, and further comprising:

both inner and outer shroud extensions include a plurality of diffusion slots spaced along the shroud leading edge.

6. The guide vane of claim 5, and further comprising:

each diffusion slot is in fluid communication with a separate cooling supply channel and a separate metering hole.

7. The guide vane of claim 1, and further comprising:

the metering hole is positioned near an upstream end of the cooling supply channel in a direction of a hot gas flow through the vane.

8. The guide vane of claim 1, and further comprising:

the cooling supply channel passes substantially along the shroud extension that is exposed to a hot gas flow of a turbine.

9. The guide vane of claim 2, and further comprising:

some of the diffusion slots are connected to separate cooling supply channels with a separate metering hole.

10. The guide vane of claim 2, and further comprising:

the diffusion slots open onto the platform surface that the vane airfoil extends from such that the cooling air exiting the diffusion slots forms a layer of film air against a hot gas flow over the platform surface.

* * * * *